US005824445A

United States Patent [19]

Ochiai et al.

[11] Patent Number: 5,824,445

[45] Date of Patent: Oct. 20, 1998

[54] PROCESS FOR PRODUCING IMAGE AND TWO-COMPONENT DEVELOPER

[75] Inventors: Eiji Ochiai; Makoto Hamaguchi; Hiroyoshi Tode, all of Mie, Japan

[73] Assignee: Kyocera Corporation, Kyoto, Japan

[21] Appl. No.: 855,789

[22] Filed: May 12, 1997

Related U.S. Application Data

[63] Continuation of Ser. No. 484,725, Jun. 7, 1995, abandoned.

[30] Foreign Application Priority Data

Jun. 30, 1994 [JP] Japan ..... 6-173335

[51] Int. Cl.[6] ..... G03G 9/083

[52] U.S. Cl. ..... 430/106.6; 430/107; 430/108; 430/111

[58] Field of Search ..... 430/106.6, 107, 430/108, 111

[56] References Cited

U.S. PATENT DOCUMENTS

| | | | |
|---|---|---|---|
| 5,239,342 | 8/1993 | Kubo et al. | 430/122 |
| 5,381,219 | 1/1995 | Miskinis et al. | 430/125 |
| 5,395,717 | 3/1995 | Ozawa et al. | 430/106.6 |

FOREIGN PATENT DOCUMENTS

| | | |
|---|---|---|
| 59-192262 | 10/1984 | Japan . |
| 61-107259 | 5/1986 | Japan . |
| 61-88273 | 5/1986 | Japan . |
| 61-130959 | 6/1986 | Japan . |
| 62-17758 | 1/1987 | Japan . |
| 63-85756 | 4/1988 | Japan . |
| 2130558 | 5/1990 | Japan . |
| 2207275 | 8/1990 | Japan . |
| 2235070 | 9/1990 | Japan . |
| 3163567 | 7/1991 | Japan . |
| 3249762 | 11/1991 | Japan . |
| 728332 | 1/1995 | Japan . |

OTHER PUBLICATIONS

Handbook of Imaging Materials, Diamond, Ed., pp. 468–472., 1991.

*Primary Examiner*—Mark Chapman
*Attorney, Agent, or Firm*—Loeb & Loeb LLP

[57] ABSTRACT

A process for producing an image comprising the steps of: electrically charging a photoreceptor under dark; forming a latent image on the photoreceptor through selective image-wise exposure to light; and developing the latent image with a two-component developer comprising a carrier and a toner, the photoreceptor comprising a conductive substrate having thereon a photoconductive layer comprising amorphous silicon having a thickness of 25 μm or less, the carrier is a magnetic material carrier comprising particles of a magnetic material having an average particle diameter of from 35 to 60 μm, where the content of particles having a diameter of 44 μm or more is 35% by weight or more. A two-component developer comprising a carrier and a toner, the carrier comprising particles of a magnetic material having an average particle diameter of from 35 to 60 μm, where the content of particles having a diameter of 44 μm or more is 35% by weight or more.

26 Claims, 1 Drawing Sheet

PROCESS FOR PRODUCING IMAGE AND TWO-COMPONENT DEVELOPER

This is a continuation of application Ser. No. 08/484,725, filed on Jun. 7, 1995, now abandoned.

FIELD OF THE INVENTION

The present invention relates to a process for producing an image using electrophotography, and a two-component developer used in electrophotography.

BACKGROUND OF THE INVENTION

Since S. F. Carlson has developed electrophotography (U.S. Pat. No. 2,297,691), various schemes have been proposed on the basis of this technique.

Electrophotography represented by Carlson system finds wide application at present. The basic process of electrophotography comprises uniform charging of a photoreceptor, selective exposure to form an electrostatic latent image, formation of a toner image with a developer, transfer of the toner image to a receiving material, and fixing the transferred image.

Heretofore, development has been mainly accomplished by a two-component development method using a carrier and a toner or a one-component jumping development method. The present invention relates to a process for the formation of an image using the two-component development method.

In the two-component development method, in order to allow the toner to be attached to an electrostatic latent image which has been formed on a photoreceptor in the development process while preventing the toner from being attached to the nondevelopment area, it is necessary that a magnetic powder be incorporated in the toner to enhance the adsorbability to the carrier, or it is necessary that the difference between the surface potential of the photoreceptor and the development bias voltage be not less than 200 V. In the charging process, the surface potential of the photoreceptor must be not less than 500 V. After exposure, the difference between the surface potential of the photoreceptor and the potential of electrostatic latent image must be not less than 400 V.

Thus, the conventional process is disadvantageous in that it tends to cause image fogging or reduced image density unless sufficient surface charging potential and development bias voltage are obtained. Therefore, a photoreceptor capable of being charged to not less than 500 V is needed. In the case of an a-Si (amorphous silicon) photoreceptor, which has a film dielectric strength of 12 V/$\mu$m, the thickness of the photoreceptor must be not less than 34 $\mu$m to satisfy the above requirements. In the case of an organic photoreceptor (OPC), the thickness of the photoreceptor must be not less than 20 $\mu$m.

Further, an image formation system employing a high charging voltage or a high bias voltage requires a large-sized apparatus, which is not preferred from the view of energy saving.

The inventors of the present invention previously proposed that the use of a developer comprising a magnetic resin carrier, a magnetic powder carrier, and an abrasive toner on an a-Si photoreceptor makes it possible to use the developer over a longer period of time as described in JP-A-5-323655 (The term "JP-A" as used herein means an "unexamined published Japanese patent application").

SUMMARY OF THE INVENTION

An object of the present invention is to provide a process for producing an image capable of forming a sharp and high density image at a low surface charging potential and development bias voltage.

Another object of the present invention is to provide a two-component developer capable of forming a sharp and high density image at a low surface charging potential and development bias voltage.

Other objects and effects of the present invention will be apparent from the following description.

The present invention relates to a process for producing an image comprising the steps of:

electrically charging a photoreceptor under dark;

forming a latent image on the photoreceptor through selective imagewise exposure to light; and developing the latent image with a two-component developer comprising a carrier and a toner, the photoreceptor comprising a conductive substrate having thereon a photoconductive layer comprising amorphous silicon having a thickness of 25 $\mu$m or less, the carrier is a magnetic material carrier comprising particles of a magnetic material having an average particle diameter of from 35 to 60 $\mu$m, where the content of particles having a diameter of 44 $\mu$m or more is 35% by weight or more.

The present invention also relates to a two-component developer comprising a carrier and a toner, the carrier comprising particles of a magnetic material having an average particle diameter of from 35 to 60 $\mu$m, where the content of particles having a diameter of 44 $\mu$m or more is 35% by weight or more.

The carrier is preferably a composite carrier comprising a mixture of (a) a magnetic material carrier comprising particles of a magnetic material having an average particle diameter of from 35 to 55 $\mu$m, the content of particles having a diameter of 44 $\mu$m or more being 35% by weight or more, and (b) a magnetic resin carrier comprising particles of a binder resin dispersed therein fine particles of a magnetic material.

The toner is preferably an abrasive toner comprising abrasive fine particles fixed on the surface of toner particles.

DETAILED DESCRIPTION OF THE INVENTION

Figure 1:
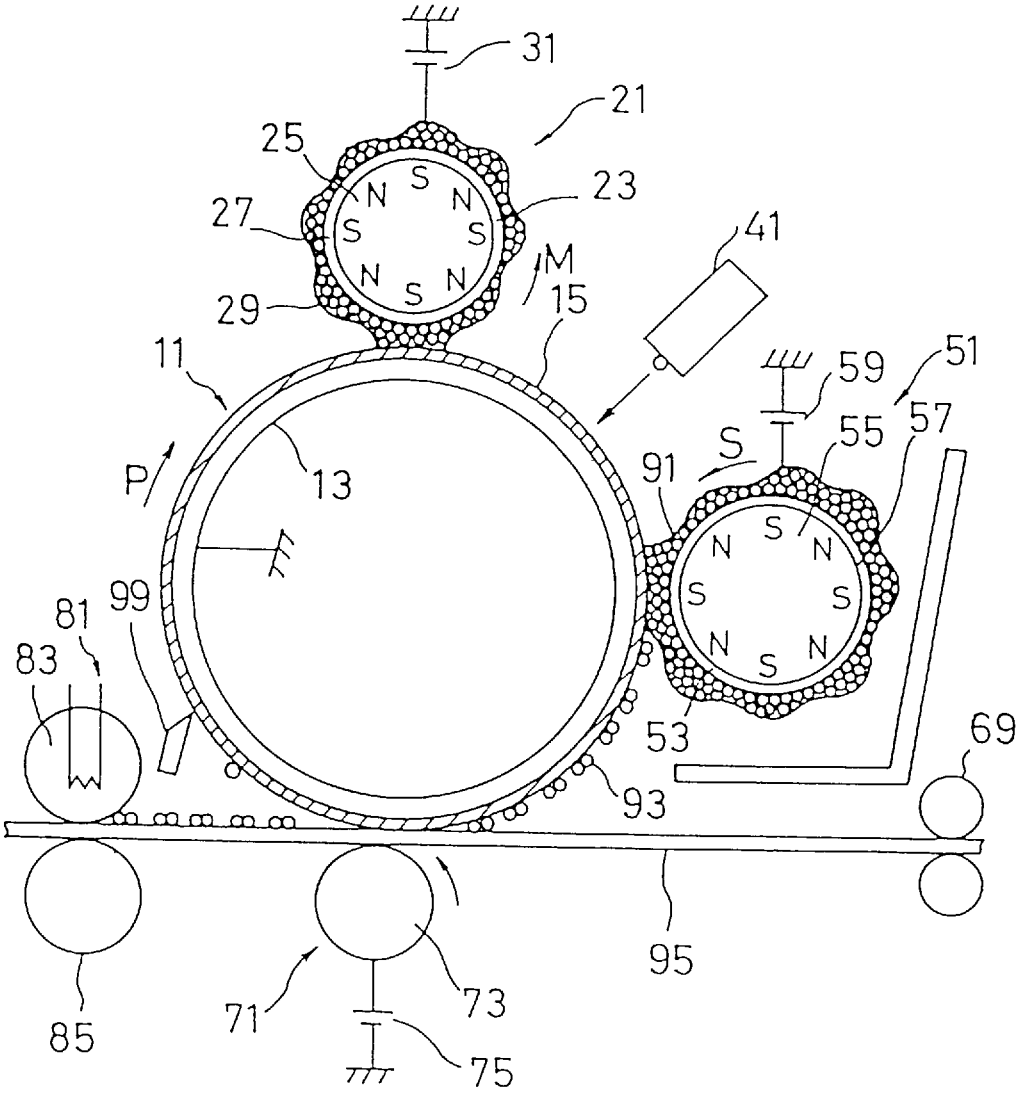
FIG. 1 shows a diagrammatic view illustrating an embodiment of the apparatus for use in the process for producing an image according to the present invention.

In the present invention, an a-Si (amorphous silicon) photoreceptor is used. The a-Si photoreceptor comprises an a-Si photoreceptor layer (photoconductive layer) provided on an electrically conductive substrate such as aluminum. A surface layer is generally provided on the photoreceptor layer for the purpose of further improving the abrasion resistance.

The a-Si photoreceptor layer may be formed by a glow discharge decomposition method, a sputtering method or the like. In the formation process, an element for terminating dangling bonds such as hydrogen and halogen is preferably incorporated in the system. In general, the photoreceptor layer is formed by a photoconductor made of a-Si:H. When the development bias voltage is positive, it is preferred that the photoreceptor is non-doped or the group Va element is incorporated in the photoreceptor to enhance the mobility of electron. When the development bias voltage is negative, the group IIIa element is preferably incorporated in the photoreceptor to enhance the mobility of positive hole. In order to provide desirable properties in electrical characteristics such as dark conductivity and photoconductivity, and optical band gap, an element such as C, O and N may be incorporated in the photoreceptor layer as necessary.

The thickness of the a-Si photoreceptor layer is 25 μm or less, preferably from 2 to 25 μm, more preferably from 8 to 25 μm. If the thickness of the a-Si photoreceptor exceeds 25 μm, development at a low charge and a low development bias voltage (hereinafter referred to as "low electric field development") becomes difficult and the production of the photoreceptor takes much time, requiring too high a production cost. If the thickness of the a-Si photoreceptor falls below 8 μm, a proper charging potential tends not to be obtained.

The surface layer preferably comprises an a-Si series inorganic high resistivity or insulating material such as a-Si, a-SiO, a-SiN, a-SiON and a-SiCON or an organic insulating material such as polyethylene terephthalate, Parylene, polyethylenetetrafluoride, polyimide and polyfluoroethyleneepropylene. In particular, a high resistivity s-SiC layer exhibits enhancement in properties such as dielectric strength, abrasion resistance and environmental resistance. The thickness of the surface layer is preferably from 0.05 to 5 μm, more preferably from 0.1 to 3 μm.

In the present invention, a two-component developer comprising a carrier and a toner in admixture is used as a developer.

In the present invention, a magnetic material carrier comprising particles of a magnetic material is used as a carrier. A magnetic powder such as ferrite, iron and magnetite, preferably ferrite is used as the magnetic material. The magnetic material carrier may be used as a non-coated carrier as it is. Alternatively, it may be coated with a resin to provide a coated carrier, or positively or negatively charging fine particles may be adhered on the surface of the carrier.

Examples of the resin coated on the carrier include silicone resins, acrylic resins, epoxy resins, and fluorine resins. By coating these resins on the carrier followed by hardening, the charging capability and the durability of the carrier can be improved.

The magnetic material carrier has an average particle diameter of from 35 to 60 μm, preferably from 35 to 55 μm. It is necessary that carrier particles having a particle diameter of not less than 44 μm account for not less than 35% by weight, preferably not less than 50% by weight of the magnetic material carrier. By defining the average particle diameter to as small as from 35 to 55 μm, low electric field development is made possible. Further, since the carrier surface area is relatively increased, a large amount of a toner can be carried onto the photoreceptor, making it possible to provide a high image density even upon low electric field development. By defining the content of carrier particles having a particle diameter of not less than 44 μm to not less than 35% by weight, the migration of carrier onto the photoreceptor during development (this phenomenon will be hereinafter referred to as "carrier drag") can be prevented.

The volume resistivity of the magnetic material carrier used in the present invention is preferably from $10^6$ to $10^{15}$ Ω.cm. The saturation magnetization σs at 1 kOe of the magnetic material carrier is preferably 50 emu/g or more.

In the present invention, the foregoing magnetic material carrier may be used in admixture with a magnetic resin carrier. The use of such a composite carrier can stably provide the toner with charge even at a high temperature and humidity, enhancing the environmental stability of the developer.

The magnetic resin carrier comprises particles of a binder resin dispersed therein particles of a magnetic material and can be obtained, e.g., by mixing fine particles of a magnetic material and a molten binder resin, cooling the mixture, and then grinding the mixture. Examples of the magnetic material include magnetite, spinel ferrite such as γ-iron oxide, spinel ferrite containing at least one metal other than iron (e.g., Mn, Ni, Cu and Mg), magnet plumbite ferrite such as barium ferrite, and iron or iron-based alloy having an oxide layer on the surface. Examples of the binder resin include a thermoplastic resin such as polystyrene resin, polyester resin, nylon resin and polyolefin resin, thermosetting resin such as phenol resin.

The magnetic resin carrier preferably has an average particle diameter of from 50 to 70 μm. In particular, the magnetic resin carrier preferably comprises particles having a particle diameter of not less than 63 μm in an amount of not less than 45% by weight based on the weight of the magnetic resin carrier.

The volume resistivity of the magnetic resin carrier is preferably from $10^6$ to $10^{13}$ Ω.cm. The saturation magnetization σs at 1 kOe of the magnetic resin carrier is preferably 50 emu/g or more. The content of the fine particles of a magnetic material in the magnetic resin carrier is preferably from 50 to 90% by weight based on the weight of the magnetic resin carrier.

The toner may be a known toner regardless of whether it is magnetic or nonmagnetic. Preferably, an abrasive toner is used. An abrasive toner comprises abrasive fine particles fixed on the surface of toner particles. The abrasive toner is further described, e.g., in JP-A-5-323655. The toner can be obtained by incorporating a colorant, an electric charge controller, an offset inhibitor, etc. in a binder resin. The abrasive toner can be prepared by fixing fine particles of an abrasive material having a high hardness such as alumina and zirconia to the toner particles.

Examples of the binder resin include vinyl resins such as polystyrene resins, e.g., a copolymer of styrene and an acrylic compound, and polyester resins. The colorant may be various known pigments and dyes, such as carbon black. Examples of the electric charge controller include quaternary ammonium compounds, Nigrosine, Nigrosine base, Crystal Violet, and triphenyl compounds. Examples of the offset inhibitor include an olefin wax, such as low molecular weight polypropylene, low molecular weight polyethylene, and their modified products. Examples of a magnetic material for forming a magnetic toner include magnetite and ferrite.

The abrasive toner can abrade the surface of the magnetic material carrier to remove spent matters fused to the surface of the carrier during the stirring and mixing of the developer. Accordingly, the spent matters cannot accumulate and grow over the limit. Thus, a stable image quality can be provided over an extended period of time. The abrasive toner also can abrade stain away from the surface of the a-Si photoreceptor, inhibiting the deterioration of image quality such as image running.

The abrasive fine particles used in the abrasive toner generally has a particle diameter of from 0.1 to 1 μm, preferably from 0.25 to 1 μm, and preferably has the same polarity as that of the toner or is neutral. The abrasive fine particles preferably has such a shape that they has edges which attains abrasive effects. The amount of the abrasive fine particles is generally from 0.5 to 5% by weight, preferably from 1 to 3% by weight, based on the weight of the toner to which the abrasive fine particles are added.

If a magnetic resin carrier is incorporated in the developer of the present invention, the weight ratio of the magnetic resin carrier to the magnetic material carrier is preferably from 10/90 to 30/70. If the proportion of the magnetic resin carrier is too small, it gives an insufficient capability of providing the toner with charge under high temperature and humidity conditions. If the proportion of the magnetic resin carrier is too large, it gives a reduced image density.

The toner is preferably added in an amount of from 5 to 9 parts by weight per 100 parts by weight of the carrier. If the proportion of the toner is too large, it causes fogging under high temperature and humidity conditions. If the proportion of the toner is too small, it gives a reduced image density.

FIG. 1 shows a diagrammatic view illustrating an embodiment of the process for producing an image according to the present invention, but the present invention should not be construed as being limited to this embodiment.

In the peripheral of a drum photoreceptor 11 comprising an a-Si photoreceptor layer 15 formed on an electrically conductive support 13, a charging unit 21, an exposure unit (LED exposure optical system 41), a development unit 51, a transfer unit 71, and a fixing unit 81 are provided. An a-Si surface layer on the surface of the photoreceptor 11 is not shown. The photoreceptor 11 rotates in the direction P.

The photoreceptor 11 is charged under dark by means of the charging unit 21.

The charging unit 21 comprises a magnet roller 25 provided thereinside, a magnetic brush roller 23 having a charging sleeve 27, electrically conductive and magnetic charging particles 29, and a charging bias power supply 31. The charging particles 28 are electrically conductive members into which a voltage is supplied from the charging bias power supply 31 via the charging sleeve 27. The charging particles 28 are then brought into contact with the photoreceptor 11 to inject electric charge into the photoreceptor 11 so that the photoreceptor be charged. The charging particles 28 are magnetically connected to the magnetic brush roller 23 to form a so-called magnetic brush which rotates in contact with the photoreceptor with the rotation of the magnetic brush roller 23. The magnetic brush roller 23 rotates in the direction M.

The surface charging potential of the photoreceptor 11 is preferably not more than 400 V, more preferably not more than 300 V. The image formation process according to the present invention is characterized in that development can be effected at a lower surface charging potential. The lowest required surface potential is not specifically limited so far as it can form an image. It is normally not less than 30 V, preferably not less than 100 V. The magnitude of potential herein is an absolute value, and its polarity (positive or negative) is appropriately determined.

The embodiment of FIG. 1 refers to the case where a contact charging apparatus comprising magnetic electrically conductive particles is used in the charging unit 21. Other contact charging apparatus comprising an electrically conductive brush or electrically conductive roller, and a corona charging apparatus comprising a corotron charger or scorotron charger may also be used. Since the required charge is small in the present invention, contact charging can be easily effected, and any of contact charging and corona charging can be effected with a miniaturized apparatus at a reduced power. Moreover, even if corona charging is effected, the produced amount of ozone is remarkably reduced as compared with the conventional process.

The photoreceptor 11 which has been uniformly charged on its surface is imagewise exposed to light from the LED exposure optical system 41. The imagewise exposure causes selective drop in the surface potential of the exposed area to form an electrostatic latent image consisting of a low potential portion and a high potential portion.

The potential difference between the low potential portion and the high potential may be not more than 350 V, preferably not more than 250 V. As mentioned above, the image formation process according to the present invention is characterized by a low required charging potential, e.g., low required contrast potential. The lower limit of contrast potential is not specifically limited so far as it can form an image. It is generally not less than 30 V, preferably not less than 100 V.

Thus, since the potential drop due to exposure can be minimized, the exposure amount can be minimized, widening the freedom of selection of exposure apparatus, reducing the size of the apparatus and saving energy.

In the embodiment of FIG. 1, taking into account the application to a printer, the potential of the position corresponding to the image area is reduced by means of the LED exposure optical system 41. The LED exposure optical system 41 comprises a combination of an LED array having LED chips linearly arranged in a number equal to the number of recorded picture elements and a converging optical system made of a Celfock lens. The LED exposure optical system may be replaced by a laser exposure optical system comprising a rotary mirror and an f-θ lens. Alternatively, if applied to a copying machine, a copying optical system for allowing the original to emit reflected light may be used.

The photoreceptor 11 having an electrostatic latent image is then developed by means of the development unit 51.

The development unit 51 supplies a developer 91 onto the surface of the photoreceptor 11 through the development roller 53. To the development sleeve 57 of the development roller 53 is connected a development bias power supply 59 for applying a development bias voltage across the photoreceptor 11 and the development roller 53. In the development roller 53, a magnetic roller 55 having a number of magnetic poles (N and S poles) is contained in the development sleeve 57. In this embodiment, the photoreceptor 11 and the development roller 53 are rotated in the direction P and the direction S (forward direction), respectively, so that the developer 91 is carried and supplied onto the surface of the photoreceptor 11. The development roller 53 may be rotated by driving either or both of the magnetic roller 55 and the development sleeve 57.

During the development process, a bias voltage is applied from the development bias power supply 59 to generate a development bias field across the development roller 53 and the photoreceptor 11. The development bias voltage (potential of the development sleeve 57) is preferably not more than 350 V, more preferably not more than 250 V.

In the development process, the toner in the developer 91 is selectively attached to the electrostatic latent image formed on the photoreceptor 11 to form a toner image on the photoreceptor 11.

In the present invention, the use of an a-Si photoreceptor layer having a thickness of not more than 25 $\mu$m and a magnetic material carrier having a relatively small particle diameter enables development at a low bias voltage even if the volume resistivity of the carrier is high, increasing the freedom of selection of carrier.

The visible image made of the toner 93 formed on the photoreceptor 11 by the development unit 51 is then transferred to paper 95 by means of a transfer roller 73 in a transfer unit 71 to which a negative bias voltage has been applied by a transfer bias voltage power supply 75. Shown at reference numeral 69 is a resist roller for feeding the paper 95.

The toner thus transferred is then fixed to the paper 95 by means of a fixing roller 83 (heating roller) in a fixing unit 81. Shown at reference numeral 85 is a pressure roller. The toner which has been left untransferred is then removed from the photoreceptor 11 by means of a cleaning blade 99.

The present invention has been described with reference mainly to the case where the image formation is effected by positively charging the photoreceptor 11, and then subjecting the electrostatic latent image to reversal development with a two-component developer. However, the present invention is not limited to this process but can also be applied to other development processes such as positive development process.

In accordance with the present invention, a high density sharp image can be formed at a low charging potential and a low development bias voltage by forming an electrostatic latent image on a photoreceptor comprising an a-Si photoreceptor layer having a thickness of not more than 25 μm, and then developing the electrostatic latent image with a developer comprising a magnetic material carrier having a predetermined particle diameter and particle size distribution.

The present invention will be described in more detail below with reference to Examples but should not be construed as being limited thereto.

EXAMPLE 1

An image was formed under normal temperature and humidity conditions (24° C. and 50%RH).

A drum photoreceptor comprising an a-Si photoreceptor layer having a thickness of 20 μm was used as a photoreceptor. The photoreceptor was uniformly charged to 240 volt by means of a charger.

The photoreceptor was then imagewise exposed to light to form a black solid latent image thereon. The latent image was then developed with a developer at a development bias voltage of 210 volt, transferred to ordinary paper, and then fixed to form a black solid image. The black solid image was then measured for image density along with the evaluation of occurrence of fog.

A mixture of a ferrite carrier (F304 available from Powder Teck Co., Ltd.) having various particle diameters and particle size distributions set forth in Table 1 and an abrasive toner comprising alumina as an abrasive fixed thereto (average particle diameter: 7 μm) was used as a developer. The toner was added in an amount of 7 parts by weight based on 100 parts by weight of the carrier. The results of evaluation are set forth in Table 1. An image density of not less than 1.4 is acceptable.

An experiment was conducted in the same manner as above except that the ambient conditions were altered to 35° C. and 80%RH. As a result, fog occurred.

In further experiments, a mixed carrier comprising a 80/20 (by weight) mixture of a magnetic material carrier and MRC-8264 available from Toda Kogyo Corp. as a magnetic resin carrier was used. As a result, no fog occurred. In Sample Nos. 1-1 and 1-2, an image density of not less than 1.40 was obtained.

TABLE 1

| | Sample No. | | | |
|---|---|---|---|---|
| | 1-1 | 1-2 | 1-3 | 1-4 |
| Carrier | | | | |
| Average particle diameter (μm) | 45 | 55 | 60 | 80 |
| Proportion of particles having diameter of not less than 44 μm | 50 | 62 | 76 | 85 |
| Evaluation results | | | | |
| Image density | 1.45 | 1.42 | 1.37 | 1.25 |
| Fog* | A | A | A | A |
| Total judgement** | A | A | B | C |

Note:
*A: No fog occurred, B: Fog occurred.
**A: Excellent, B: Acceptable, C: Poor

EXAMPLE 2

80 parts by weight of a ferrite carrier having an average particle diameter and particle size distribution set forth in Table 2 and 20 parts by weight of a magnetic resin carrier having an average particle diameter of 60 μm comprising particles having a particle diameter of not less than 63 μm in an amount of 45% were mixed to prepare a composite carrier. An abrasive toner was then incorporated in the composite carrier in an amount of 7 parts by weight to prepare a developer.

Photoreceptors having various drum thickness (thickness of a-Si photoreceptor layer) were prepared. Conditions under which an image density of not less than 1.40 can be obtained without causing fog were experimentally determined. The results are set forth in Table 2.

TABLE 2

| | Sample No. | | | | | |
|---|---|---|---|---|---|---|
| | 2-1 | 2-2 | 2-3 | 2-4 | 2-5 | 2-6 |
| Carrier | | | | | | |
| Average particle diameter (μm) | 45 | 55 | 80 | 45 | 55 | 60 |
| Proportion of particles having diameter of not less than 44 μm | 50 | 62 | 85 | 50 | 62 | 76 |
| Dram thickness (μm) | 25 | 25 | 35 | 39 | 39 | 39 |
| Predetermined surface potential (V) | 300 | 300 | 470 | 470 | 470 | 470 |
| Development bias Vb (V) | 210 | 210 | 380 | 380 | 380 | 380 |
| Evaluation results | | | | | | |
| Carrier* | A | A | C | C | C | C |
| Evaluation of image** | A | A | C | C | C | C |

Note:
*A: No carrier drag occurred, C: Carrier drag occurred
**A: No problem with image, C: Practical problem with image It can be seen in Table 2 that the reduction of the drum thickness to not more than 25 μm as in Sample Nos. 2-1 and 2-2 enables the formation of an image at a low charging voltage and a low bias voltage.

In Sample Nos. 2-4 to 2-7, a resin carrier having a less specific gravity than ferrite carrier was developed on letters and lines with the toner, causing carrier drag.

EXAMPLE 3

An image was formed under normal temperature and humidity conditions (35° C. and 80%RH).

A drum photoreceptor comprising an a-Si photoreceptor layer having a thickness of 25 μm was used as a photoreceptor. The photoreceptor was uniformly charged to 300 volt by means of a charger.

The photoreceptor was then imagewise exposed to light to form a black solid latent image thereon. The latent image was then developed with a developer at a development bias voltage of 210 volt, transferred to ordinary paper, and then fixed to form a black solid image. The black solid image was then measured for image density along with the evaluation of occurrence of fog.

A mixture of a ferrite carrier having percent compositions set forth in Table 1, a resin carrier, and an abrasive toner (average particle diameter: 7 μm) was used as a developer. A particulate carrier having an average particle diameter of 45 μm comprising particles having a particle diameter of not less than 44 μm in an amount of 50% by weight was used as the ferrite carrier. The resin carrier has an average particle diameter of 60 μm and comprises particles having a particle diameter of not less than 63 μm in an amount of 45% by weight. The results of evaluation are set forth in Table 3.

TABLE 3

| | Sample No. | | | | | | | | | |
|---|---|---|---|---|---|---|---|---|---|---|
| | 3-1 | 3-2 | 3-3 | 3-4 | 3-5 | 3-6 | 3-7 | 3-8 | 3-9 | 3-10 |
| Mixing ratio (by weight) | | | | | | | | | | |
| Toner | 3 | 5 | 7 | 9 | 11 | 7 | 7 | 7 | 7 | 7 |
| Magnetic carrier | 80 | 80 | 80 | 80 | 80 | 60 | 70 | 80 | 90 | 100 |
| Resin carrier | 20 | 20 | 20 | 20 | 20 | 40 | 30 | 20 | 10 | 0 |
| Evaluation | | | | | | | | | | |
| Image density | 1.33 | 1.40 | 1.44 | 1.44 | 1.44 | 1.30 | 1.40 | 1.44 | 1.44 | 1.44 |
| Fog* | A | A | A | A | C | A | A | A | B | C |
| Total judgement** | C | A | A | A | C | C | A | A | B | C |

Note:
*A: No fog occurred, B: Non-appreciable fog occurred on white background, C: Fog occurred
**A: Excellent; B: Good, C: Acceptable It can be seen from Table 3 that the amount of the toner of from 5 to 9 parts by weight per 100 parts by weight of the carrier provide better results, and the weight ratio of the magnetic resin carrier to the magnetic material carrier of from 10/90 to 30/70 also provides better results.

While the invention has been described in detail and with reference to specific examples thereof, it will be apparent to one skilled in the art that various changes and modifications can be made therein without departing from the spirit and scope thereof.

What is claimed is:

1. A process for producing an image comprising the steps of:

electrically charging a photoreceptor under dark;

forming a latent image on said photoreceptor through selective imagewise exposure to light; and developing said latent image with a two-component developer comprising a carrier and a toner, said photoreceptor comprising a conductive substrate having thereon a photoconductive layer comprising amorphous silicon having a thickness of 25 μm or less, wherein said carrier is a composite carrier comprising a mixture of (a) a magnetic material carrier comprising particles of a magnetic material having an average particle diameter of from 35 to 60 μm, where the content of particles having a diameter of 44 μm or more is 35% by weight or more, and (b) a magnetic resin carrier comprising particles of a binder resin dispersed therein fine particles of a magnetic material.

2. A process for producing an image as claimed in claim 1, wherein said carrier is a composite carrier comprising a mixture of (a) a magnetic material carrier comprising particles of a magnetic material having an average particle diameter of from 35 to 55 μm, the content of particles having a diameter of 44 μm or more being 35% by weight or more, and (b) a magnetic resin carrier comprising particles of a binder resin dispersed therein fine particles of a magnetic material.

3. A process for producing an image as claimed in claim 2, wherein said toner is an abrasive toner comprising abrasive fine particles fixed on the surface of toner particles.

4. A process for producing an image as claimed in claim 2, wherein said photoreceptor is electrically charged under dark to 400 V or less.

5. A process for producing an image as claimed in claim 4, wherein said photoreceptor is electrically charged under dark to 300 V or less.

6. A process for producing an image as claimed in claim 2, wherein said magnetic material is ferrite.

7. A process for producing an image as claimed in claim 2, wherein said magnetic resin carrier has an average particle diameter of from 50 to 70 μm, where the content of particles having a diameter of 63 μm or more is 45% by weight or more.

8. A process for producing an image as claimed in claim 2, wherein the weight ratio of said magnetic resin carrier to said magnetic material carrier is from 10/90 to 30/70.

9. A process for producing an image as claimed in claim 2, wherein the amount of said toner is from 5 to 9 parts by weight per 100 parts by weight of said carrier.

10. A process for producing an image as claimed in claim 1, wherein said toner is an abrasive toner comprising abrasive fine particles fixed on the surface of toner particles.

11. A process for producing an image as claimed in claim 1, wherein said photoreceptor is electrically charged under dark to 400 V or less.

12. A process for producing an image as claimed in claim 5, wherein said photoreceptor is electrically charged under dark to 300 V or less.

13. A process for producing an image as claimed in claim 1, wherein said photoconductive layer has a thickness of from 8 to 25 μm.

14. A process for producing an image as claimed in claim 13, wherein said photoconductive layer has a thickness of from 2 to 25 μm.

15. A process for producing an image as claimed in claim 1, wherein said magnetic material is ferrite.

16. A process for producing an image as claimed in claim 1, wherein said magnetic material carrier has an average particle diameter of from 35 to 55 μm, where the content of particles having a diameter of 44 μm or more is 50% by weight or more.

17. A process for producing an image as claimed in claim 1, wherein the amount of said toner is from 5 to 9 parts by weight per 100 parts by weight of said carrier.

18. A two-component developer comprising a carrier and a toner, said carrier is a composite carrier comprising a mixture of (a) a magnetic material having an average particle diameter of from 35 to 60 μm, where the content of the particles having a diameter of 44 μm or more is 35% by weight or more, and (b) a magnetic resin carrier comprising particles of a binder resin dispersed therein fine particles of a magnetic material.

19. A two-component developer as claimed in claim 18, wherein said carrier is a composite carrier comprising a mixture of (a) a magnetic material carrier comprising particles of a magnetic material having an average particle diameter of from 35 to 55 μm, the content of particles having a diameter of 44 μm or more being 35% by weight or more, and (b) a magnetic resin carrier comprising particles of a binder resin dispersed therein fine particles of a magnetic material.

20. A two-component developer as claimed in claim 19, wherein said toner is an abrasive toner comprising abrasive fine particles fixed on the surface of toner particles.

21. A two-component developer as claimed in claim 19, wherein said magnetic resin carrier has an average particle diameter of from 50 to 70 μm, where the content of particles having a diameter of 63 μm or more is 45% by weight or more.

22. A two-component developer as claimed in claim 19, wherein the weight ratio of said magnetic resin carrier to said magnetic material carrier is from 10/90 to 30/70.

23. A two-component developer as claimed in claim 19, wherein the amount of said toner is from 5 to 9 parts by weight per 100 parts by weight of said carrier.

24. A two-component developer as claimed in claim 18, wherein said toner is an abrasive toner comprising abrasive fine particles fixed on the surface of toner particles.

25. A two-component developer as claimed in claim 18, wherein said magnetic material carrier has an average particle diameter of from 35 to 55 μm, where the content of particles having a diameter of 44 μm or more is 50% by weight or more.

26. A two-component developer as claimed in claim 18, wherein the amount of said toner is from 5 to 9 parts by weight per 100 parts by weight of said carrier.

* * * * *